US007105041B2

(12) United States Patent
Dunn

(10) Patent No.: US 7,105,041 B2
(45) Date of Patent: Sep. 12, 2006

(54) GRID TYPE ELECTROSTATIC SEPARATOR/COLLECTOR AND METHOD OF USING SAME

(76) Inventor: John P. Dunn, 240 Stuart St., Apt. A, Horseheads, NY (US) 14845

( * ) Notice: Subject to any disclaimer, the term of this patent is extended or adjusted under 35 U.S.C. 154(b) by 17 days.

(21) Appl. No.: 10/872,981

(22) Filed: Jun. 21, 2004

(65) Prior Publication Data

US 2004/0226446 A1 Nov. 18, 2004

Related U.S. Application Data

(63) Continuation-in-part of application No. 10/225,523, filed on Aug. 21, 2002, now Pat. No. 6,773,489.

(51) Int. Cl.
*B03C 3/36* (2006.01)

(52) U.S. Cl. ..... 96/66; 96/70; 96/76

(58) Field of Classification Search ..... 96/54, 96/60, 66, 70, 76; 95/78, 79; 209/127.1, 209/12.2

See application file for complete search history.

(56) References Cited

U.S. PATENT DOCUMENTS

| | | | | |
|---|---|---|---|---|
| 2,361,946 A | | 11/1944 | Johnson et al. | 209/127.3 |
| 2,803,344 A | | 8/1957 | Morrison | 209/127.4 |
| 2,836,725 A | | 5/1958 | Vyverber | 250/326 |
| 3,566,110 A | | 2/1971 | Gillespie et al. | 250/324 |
| 3,635,340 A | | 1/1972 | Dunn | 209/130 |
| 3,739,554 A | | 6/1973 | Whetten et al. | 96/54 |
| 3,768,258 A | * | 10/1973 | Smith et al. | 60/275 |
| 3,820,306 A | | 6/1974 | Vincent | 96/54 |
| 4,071,169 A | | 1/1978 | Dunn | 222/71 |
| 4,153,836 A | | 5/1979 | Simm | 250/325 |
| 4,172,028 A | | 10/1979 | Dunn | 209/12.2 |
| 4,233,037 A | | 11/1980 | Pontius et al. | 95/79 |
| 4,354,858 A | * | 10/1982 | Kumar et al. | 95/78 |
| 4,726,812 A | | 2/1988 | Hirth | 95/80 |
| 4,745,282 A | | 5/1988 | Tagawa et al. | 250/326 |
| 4,762,997 A | | 8/1988 | Bergen | 250/326 |
| 4,905,470 A | | 3/1990 | Reichle et al. | 60/275 |
| 5,118,942 A | | 6/1992 | Hamade | 250/324 |
| 5,203,166 A | | 4/1993 | Miller | 60/274 |
| 5,426,936 A | | 6/1995 | Levendis et al. | 60/278 |

(Continued)

OTHER PUBLICATIONS

"Burning Coal Superclean" Machine Design, Dec. 12, 2002 p. 45.

(Continued)

*Primary Examiner*—Richard L. Chiesa
(74) *Attorney, Agent, or Firm*—Brown & Michaels, PC

(57) ABSTRACT

An electrical type grid electrostatic collector/separator removes particles from an air stream. The apparatus includes multiple parallel grids that act as the porous material, enclosed in a sealed compartment so that the entrained air flows parallel and between one or more centrally located grids. A direct current high voltage field is established between the grids with the polarities alternating between facing grids. Finer particles may be temporally collected on plate or grid assemblies that are located out of the airflow. When non-conductive particles are present, external methods of pre-charging by corona discharge are preferably used. When non-conductive particles are present, both internal and external methods of pre-charging by corona discharge are used with the external method being preferred.

27 Claims, 11 Drawing Sheets

U.S. PATENT DOCUMENTS

| | | | | |
|---|---|---|---|---|
| 6,176,902 | B1 * | 1/2001 | Matsubara | 96/66 |
| 6,482,253 | B1 | 11/2002 | Dunn | 96/62 |
| 6,585,809 | B1 * | 7/2003 | Parsa | 96/16 |
| 6,773,489 | B1 * | 8/2004 | Dunn | 95/78 |
| 2004/0035292 | A1 * | 2/2004 | Dunn | 95/57 |

OTHER PUBLICATIONS

White, Harry J. Industrial Electrostatic Precipitation Addison-Wesley Publishing Company, Inc., MA, 1963, p. 159.

* cited by examiner

FIG. 9
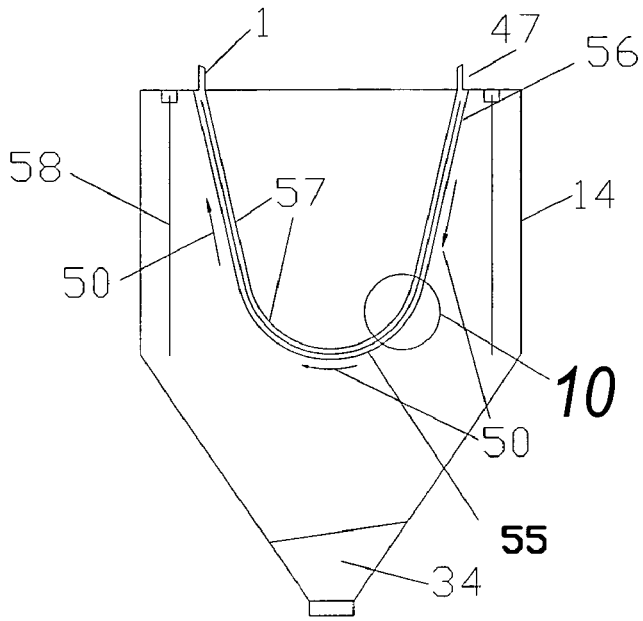
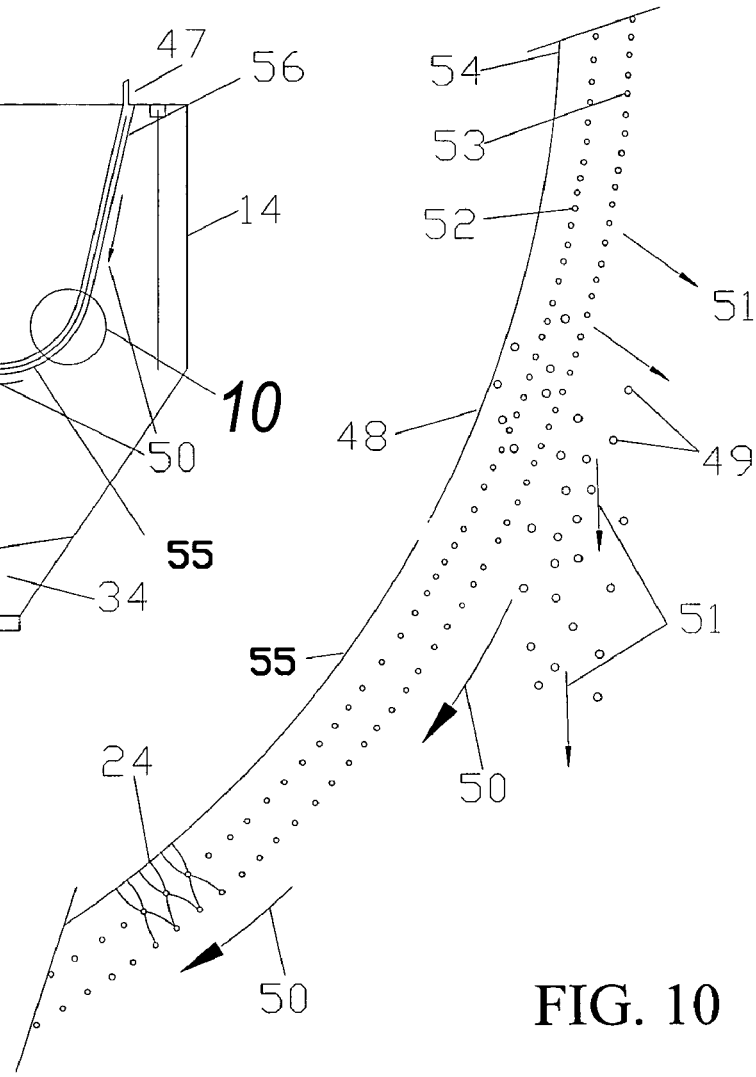
FIG. 10

GRID TYPE ELECTROSTATIC SEPARATOR/COLLECTOR AND METHOD OF USING SAME

REFERENCE TO RELATED APPLICATIONS

This application is a continuation-in-part of parent patent application entitled "GRID TYPE ELECTROSTATIC SEPARATOR/COLLECTOR AND METHOD OF USING SAME", Ser. No. 10/225,523, filed Aug. 21, 2002, now U.S. Pat. No. 6,773,489. The aforementioned application is hereby incorporated herein by reference.

BACKGROUND OF THE INVENTION

1. Field of the Invention

The invention pertains to the field of separator apparatuses. More particularly, the invention pertains to an apparatus that can function as a filter unit as a precipitator or as a separator of materials that have different electrical properties.

2. Description of Related Art

U.S. Pat. No. 4,172,028 discloses an electrostatic sieve having parallel sieve electrodes that are either vertical or inclined. The particles are normally introduced into the electric sieve under the control of a feeder that is placed directly in front of the opposing screen electrode. The powder is attracted directly from the feeder tray to the opposing screen electrode by induced electric field that exists between the tray and the screen electrode. This system is a static air system.

Prior art precipitators have difficulty collecting highly conductive and very poorly conductive particulates.

SUMMARY OF THE INVENTION

The invention relates to a method and apparatus for removing particles from an air stream. The electrical type separator apparatus preferably includes multiple parallel grids, enclosed in a sealed compartment so that the entrained air flows parallel and between one or more centrally located grids. A direct current high voltage field is established between the grids with the polarities alternating between facing grids. The system is preferably used on conductive and semi-conductive materials because the particles receive an induced charge with ease. The charged particles are separated and collected when they are attracted toward the relatively open wire or woven grids and pass laterally through and onto the next attracting grid until they are out of the air stream and generally fall by gravity into the collection vessel. When processing non-conductive particles, either internal corona charging or preferably external methods of pre-charging by corona discharge are used.

BRIEF DESCRIPTION OF THE DRAWINGS

FIG. 9 shows a cross sectional view of a modified-U-shaped electrode grid separator/collector apparatus of the present invention.

FIG. 10 shows an enlarged cross-sectional view of the radius of the U shaped electrode grid separator/collector and the interaction of the various forces affecting separation.

DETAILED DESCRIPTION OF THE INVENTION

Figure 1:
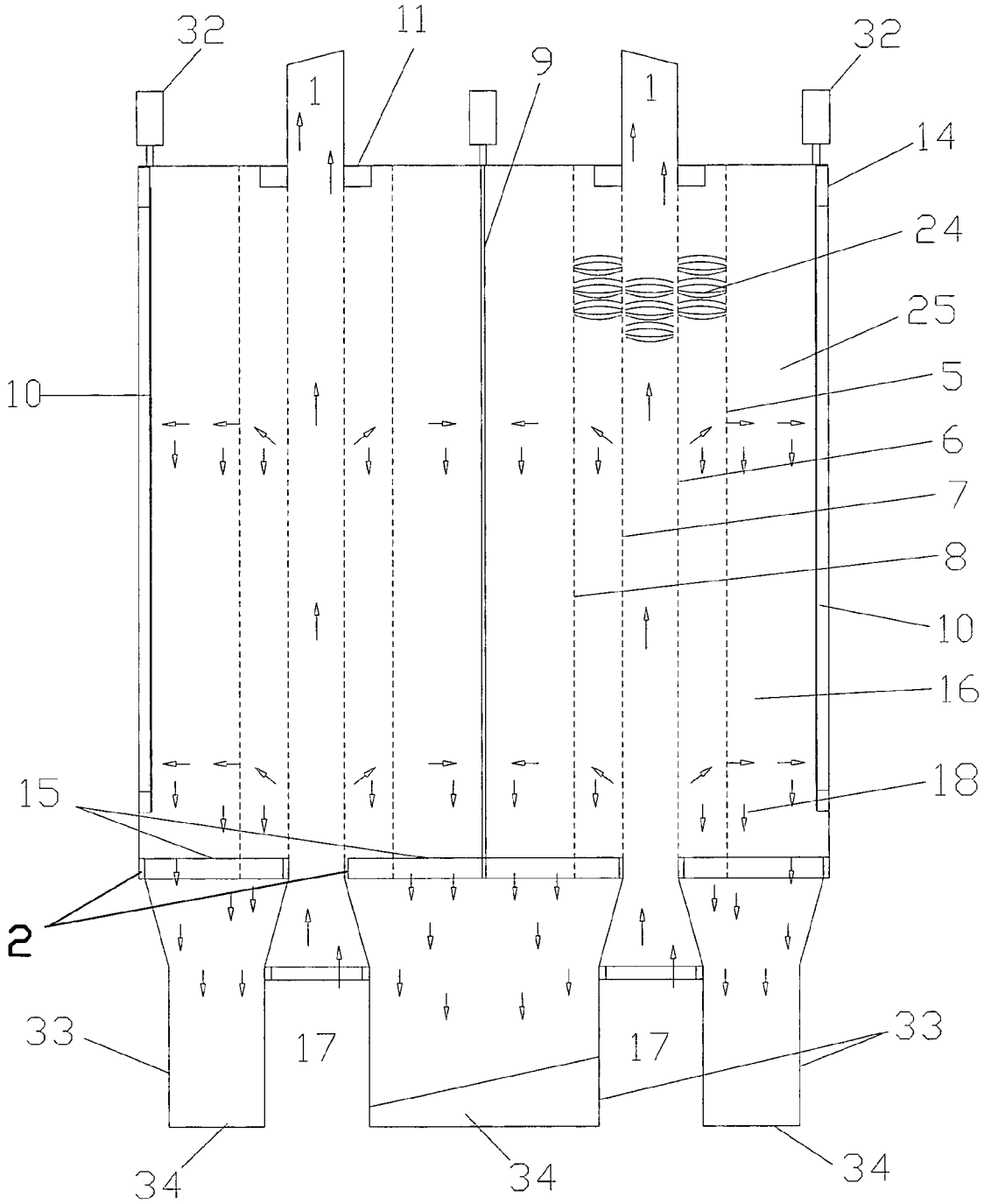
FIG. 1 shows a cross sectional view of a cylindrical or rectangular multiple grid separator/collector of the present invention.

One of the differences between the grid electrostatic separator/collector (GES/C) of the present invention and the Electric Sieve (ES) technology shown in U.S. Pat. No. 4,172,028 is that the ES apparatus is a static air system while the present invention is a dynamic gas system. The present invention is a dynamic system with entrained air flowing between the charging and attracting electrode. Separated particles are collected by gravity or on a plate electrode. The plate electrode is located in a relatively static air environment and out of the moving air stream. This eliminates the normal particle re-entrainment during plate cleaning.

Unlike the prior art precipitators, the GES/C apparatus of the present invention separates the solid particles from the air stream by using an induced electric field between two grid electrodes, and uses a combination of a corona field to generate the necessary polarized ions and either charged or grounded grids to attract the particles laterally or perpendicular to the airflow.

The basic design of the various filter and precipitator embodiments described herein use either wire or woven wire grids to laterally remove particles from a moving air stream. Methods known in the art are used to charge and collect the particles.

The GES/C system introduces the particles by an entrained gas stream that flows between two electrodes. Both electrodes preferably have a high voltage direct current each having a different polarity. In a preferred embodiment, the arrangement has one polarized charging electrode and an opposing electrode at ground potential.

Dry particulate precipitators in the prior art are generally composed of apposing plate and corona wire electrode combinations. Both in the proposed and standard precipitators, particles can be charged prior to entering the deposition area or in an area where both corona charging and deposition operations occur.

The charged particles are separated from the air stream when they traverse laterally through one or more grids until they are out of the influence of the air stream. Lateral movement of the particles occurs because each grid has the opposite polarity that develops an attractive field perpendicular to the air stream. This electrode arrangement induces an electrical stress on the particles resulting in a continuous movement of the particles away from the preceding grid electrode.

For conductive and semi-conductive particles, the particles move freely through the grids and away from the air stream. The number of grids and the spacing between grid wires can vary depending on the volume and air velocity and the solids concentration. The more conductive, higher density particles that have moved out of the air stream are collected by gravity. Finer particles that tend to remain suspended are generally carried out of the system by the larger particles.

For non-conductive particles that retain their charge, a more open grid structure can be used as well as continuous tapping of the grid electrodes. This allows for a freer lateral movement of the charged particles to the collecting plate electrode.

For a mixture of conductive and non-conductive particles where the non-conductors are not charged triboelectrically or by corona discharge, the non-conducting particles will pass through the apparatus with the air stream while the conducting particles will be removed laterally by electrical attraction and collected independently of the non-conducting particles. If required the non-conducting particles can be separated by a second process.

Particles generally do not adhere to the first grid because of the rapid air movement. Non-conductive particles have more of a tendency to adhere to the grids and can be dislodged by tapping, vibration or reverse polarity methods. The particles that are dislodged from these grids continue to flow laterally because the similar particle polarities repel the particles from each other.

A relatively static air movement zone collects the particles by allowing both conductive and non-conductive particles to fall by gravity or be collected on the plate electrode. The GES/C designs of the present invention maintain a controlled AP distribution that prevents internal turbulence that would interfere with the normal lateral flow of the particles. However, moderate, controlled turbulence between the first two electrodes is preferred. In most operations a sufficient negative air pressure exists at the exit end of the precipitator so the air moves as a uniform column.

The successful transfer of particles through the grids is based on the lateral electrical field attracting force being greater than the force of the transient airflow. The particles that pass through the grid follow the flux lines that are generated between progressive grid wires. The same effect occurs when a combination of a cone surface and grid wires is used. The passage through the grids is also related to the particle-to-particle interaction, angle of particle movement, particle momentum, and the relation of particle size to the grid opening. A cone-shaped electrode attenuates the airflow and at the same time increases the particle and airflow resistance by gradually increasing the surface area that the air travels over.

The present invention uses electrical field effects to remove entrained conductive and semi-conductive particles from an air stream by causing electrically polarized charged particles to move laterally or near perpendicular through and between vertical grids while the clean gas continues to flow out of the apparatus.

The present invention also removes entrained, charged non-conductive particles by using a combination of corona discharge electrodes, parallel grid electrodes and collecting plate electrodes that, when electrically active, cause the lateral movement of charged particles through the grids while the gas continues to flow out of the system.

Vertical, parallel multi grids separate and remove particles from the entrained gas stream. A horizontal apparatus removes and collects particles from the entrained gas stream. The design preferably includes a top solid plate electrode with parallel grid electrodes located below the plate electrode.

Entrained airflow is preferably contained and directed so that the separated material does not become re-entrained in the air stream. To achieve this, the present invention draws the air through the apparatus, preferably by having a blower located at the exhaust end of the apparatus. This creates a negative pressure operation in a sealed unit. In addition, input and output apertures are preferably included to allow a row or column of air to flow between the main inner electrodes. This prevents the flow of air from deviating and creating turbulence on the backside or static airside of the center main electrodes.

The present invention also collects separated particles by using a combination of gravity, plates and grid electrodes. Powder collected by the plates or the grids can be removed by squeegee or rapping or by other conventional methods.

Variable wire grid spacing along the length of the apparatus compensates for changes in both particle concentration and the finer size particles being collected. Separate electrical power zones along the length of the apparatus vary the field strengths. The present invention also improves the efficiency and rate at which entrained particles are charged and removed from an air stream.

When the apparatus of the present invention is used to separate dissimilar materials from a moving air stream, generally the conducting particles are separated from the non-conducting particles. The less conductive material is discharged with the exiting air and collected in a separate operation. Separation depends on a number of factors. Some of these factors include, but are not limited to, the difference in electrical properties, conductivity and dielectric consent (the larger the difference the better), particle size distribution, the percentage of conductive versus non-conductive particles, and density difference. Examples include the separation of materials found in fly-ash, minerals or ore products.

When processing entrained materials that have a high percentage of non-conductors, the non-conductors may have been triboelectrically charged, leaving a residual surface charge that should be removed prior to entering the separator. This is preferably accomplished by subjecting some materials to a HVAC corona discharge prior to entering the separator/collector.

The methods used to collect particles that have been separated and removed from the air stream vary depending on the electrical properties and the size of the particles. Collecting electrodes are preferably either plates or multi grid assemblies. The collecting electrodes can be grounded or have a high voltage AC, or a high voltage DC applied with the opposite polarity from the main grid electrodes.

A high concentration of similarly polarized particles can repel each other, causing some of the particles to transfer back into the main air stream. Therefore, the location and design of the collecting electrodes becomes a major factor when removing a high concentration of polarized electrically charged dust particles from an air stream. A solution to the problem is to capture or deposit these particles as quickly as possible.

FIG. 1 illustrates a cross-section of a preferred embodiment of a vertical, rectangular, dual vertical GES/C of the present invention. The apparatus includes a structural frame (14) and a center support plate electrode (9) with entrained gas entering at (17) and exiting at (1). In all of the embodiments of the present invention, it is important to have a narrow column (or row) of airflow and good control of the internal pressure. The air stream is preferably drawn into the apparatus. The entrained gas flows between a polarized charging grid (7) and the ground potential grid electrode (6). Directly behind the two input grids (6) and (7) are additional grid electrodes (8), at ground potential, and a charged grid (5). It should be understood that the apparatus could be expanded laterally so that other grid electrodes can be used to move the particles further from the air stream. The apparatus is also a sealed unit so that the air stream is restricted between the input (17) and (22) (see FIGS. 2–8) and the gas exit conduits (1). This unit can be designed to operate with the input air moving either vertically or horizontally through the apparatus.

An electric field (24) is established between the alternating electrodes (5) and (6), (6) and (7), and (7) and (8). Generally the spacing between the last grid electrodes (7) and (8), and the plate electrode results in the absence of an electric field because of the distance between the plate and the grid electrodes. The charged particles move laterally (16), and gravitationally settle (18) in the open space (25).

When processing large, high-density particles, these particles may gravitate out of the process before the next grid electrode or the collection plate electrode (10). The collecting plate electrode (10) is used when collecting fine non-conductive particles or when there is a mixture of conducting and non-conducting particles. Deposited particles are removed by a tapping apparatus (32), or by a squeegee or other removal methods. The spacing between parallel grid electrodes preferably varies between ⅜ and 1.50 inches.

The spacing between electrodes, the electrical potential between electrodes and the number of grid electrodes are each a function of the concentration of solids in the air stream, the size of the particles, electrical and physical characteristics of the particles, and flow rate, as well as other process variables.

The grid supports (2) and (11) are preferably constructed from a dielectric material with openings (15) in the collection area. The dislodged powder falls by gravity or is tapped from the plate electrodes (10) and is collected (34) at the bottom of the precipitating chamber (33).

Figure 2:
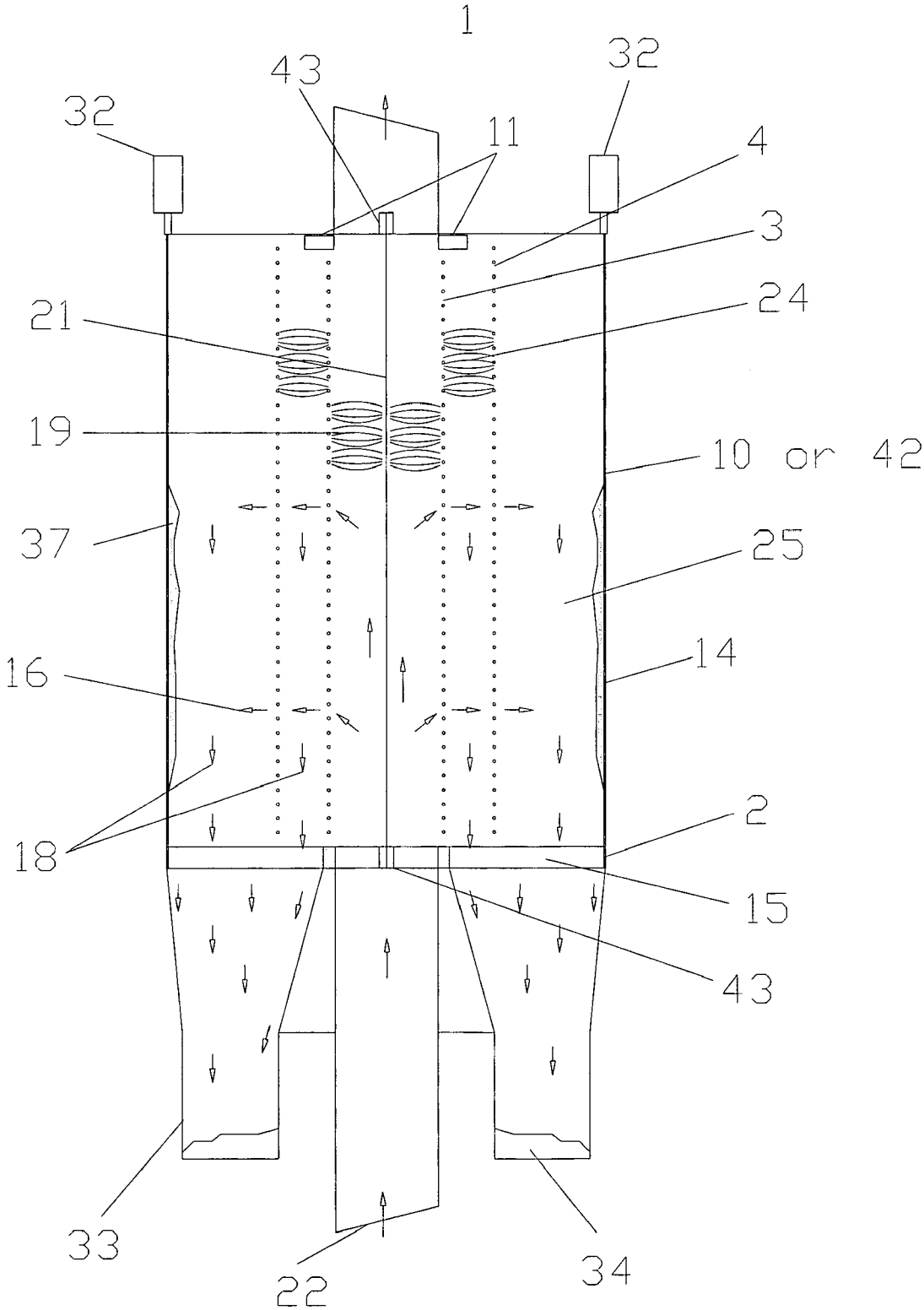
FIG. 2 shows a cross sectional view of a cylindrical or rectangular grid separator/collector of the present invention that has a center corona wire, multiple grids, and plate electrodes.

FIG. 2 illustrates another preferred embodiment of a vertical GES/C of the present invention. In this embodiment, a wire electrode (21) or other type of corona-generating electrode can be used to generate the necessary ions. The corona wire (41) is supported at both ends (43). This arrangement is preferred primarily for processing non-conductive particulates. For processing conductive particles, the corona wire is removed and the grid electrodes are moved closer together. This embodiment also uses a single input (22) in contrast with the dual input (17) shown in FIG. 1. The electric field lines of force (19) are generated at 90 degrees to the flow of the entrained gas input and illustrate the area where gas ions are produced by the corona discharge electrode (21). The charged particles that follow these lines of force result in the separation of the solid particles by passing through the grounded electrode (3) and the charged electrode (4) from the air stream (22) and are collected by gravity (18) or for some materials being deposited (37) on the plate electrode (10). When designed as a rectangular unit it can be operated with the input air moving either vertically or horizontally through the apparatus. When designed as a circular apparatus the grids are in a circular pattern and the solid plate electrode (42) is a cylinder.

Figure 3:
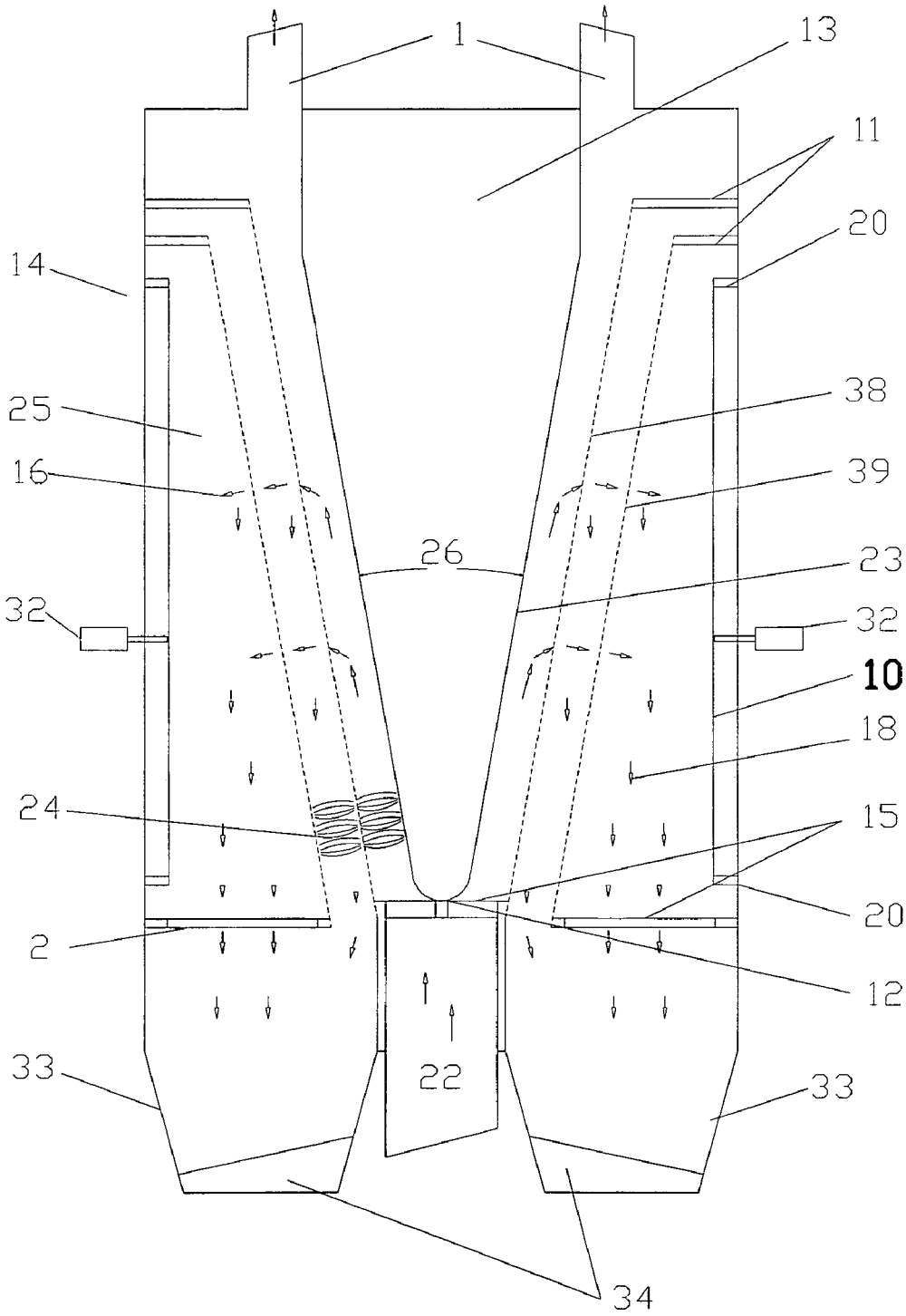
FIG. 3 shows a cross sectional view of a cylindrical grid separator/collector of the present invention with a solid surface cone electrode, multiple grids shaped to follow the contour of the inner solid cone surface, and a cylindrical plate electrode.

The design of FIG. 3 uses a cone shaped solid surface center electrode (23). The cone increases the surface area so that the entrained air meets an increased resistance to airflow resulting in a wider distribution of the entrained particles over the surface of the cone electrode. The increased drag on the flow may cause some air turbulence that also exposes more particles to the electric field (24) that exist between the cone electrode (23) and the coned shaped grid charging electrodes (38) and the grounded attracting electrode (39). The included angle (26) of the cone electrode (23) that is supported at (12) and by the upper part of the enclosure (14) can vary depending on the material being processed. Another advantage to this design is the ability to control the temperature of the cone (23) by heating or cooling the inside of the cone (13). This apparatus can have a plate electrode (10) supported at (20) for the collection of non-conductor or extremely fine conducting particles.

Figure 4:
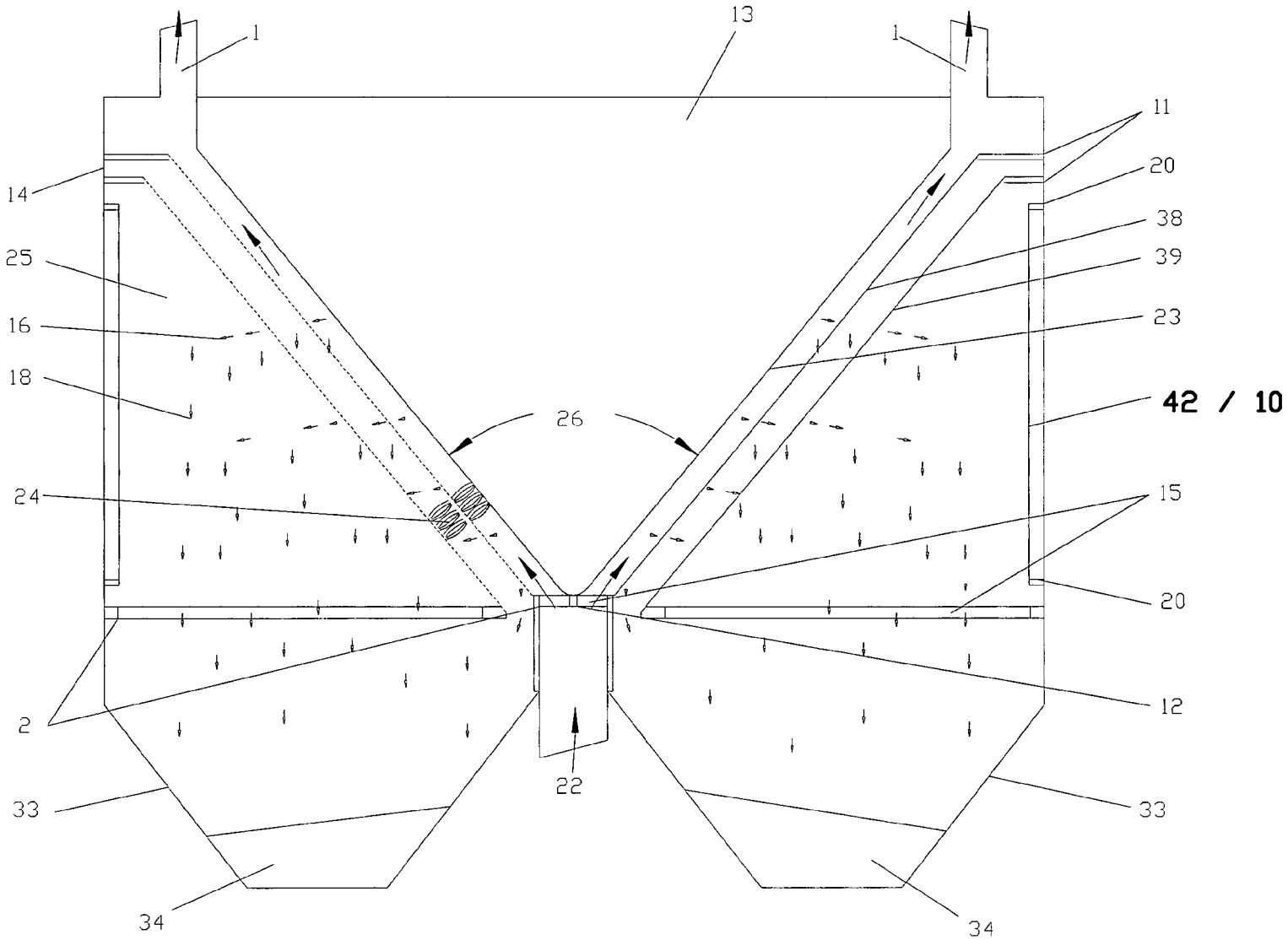
FIG. 4 shows a cross sectional view of a grid separator/collector of the present invention with a cylindrical wide-angle cone electrode, multiple grids and a plate electrode separator/collector.

FIG. 4 shows a similar apparatus to FIG. 3, with a cone electrode angle close to horizontal. The larger included angle (26) increases the effect of gravity on the particles, increases the drag on the entrained gas flow, and at the same time increases the resident time of particles in the electrical field, thereby improving the separation process. In a preferred embodiment, this angle is approximately 80°.

Figure 5:
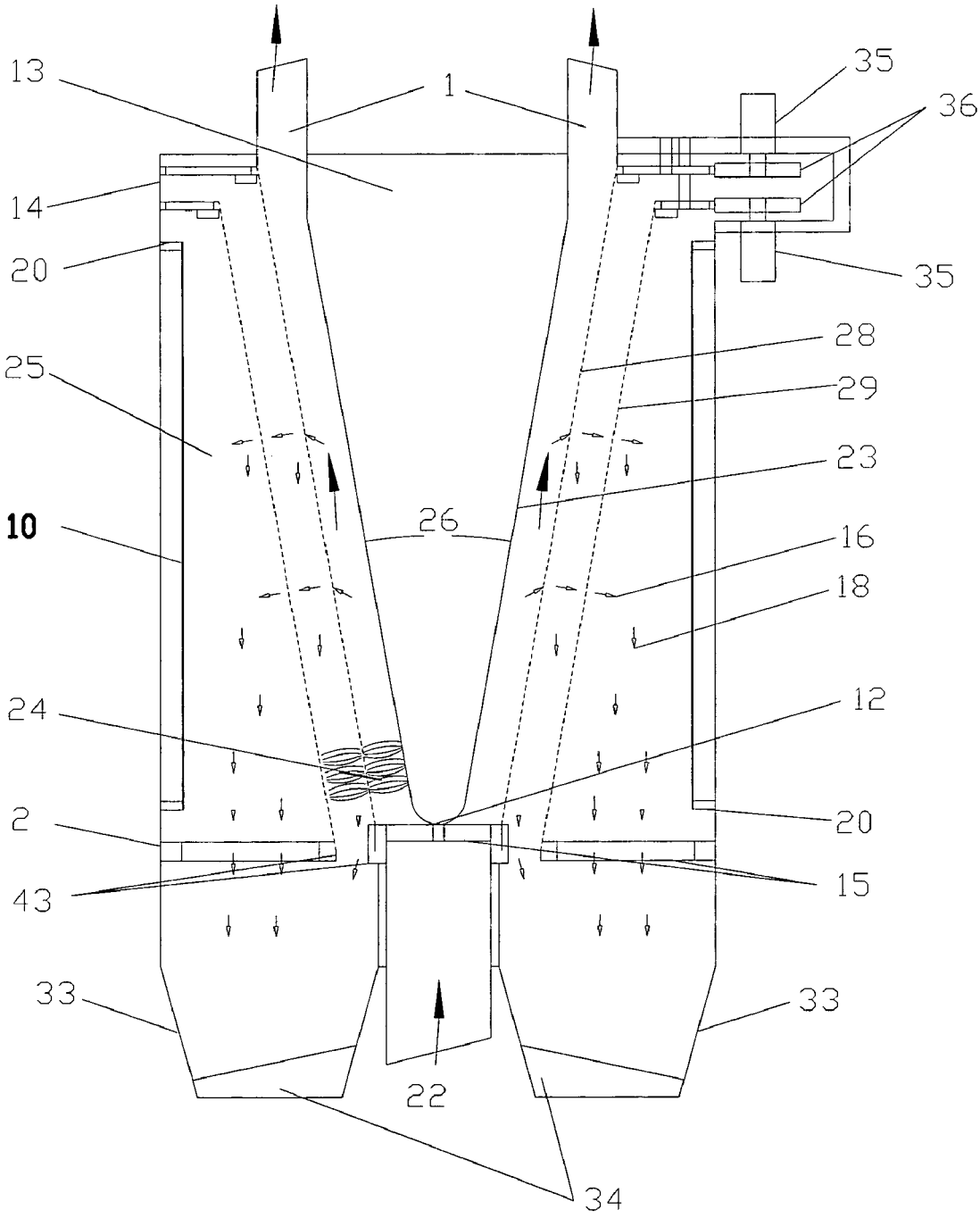
FIG. 5 shows a cross sectional view of a cylindrical grid separator/collector of the present invention with a solid surface cone electrode, rotating grid electrodes and a plate electrode.

FIG. 5 also shows a precipitator design that is similar to FIG. 3 that can process both conductive and non-conductive powders. In this embodiment, the cone shaped, grid electrodes (28) and (29) can be rotated. This embodiment is especially useful when processing a dielectric material that has been externally pre-charged. The rotation of the grid electrode (28) results in a constant change in the position of the flux lines and lines of force (24) between the grid and the cone surface. This condition adds turbulence to the particle flow and ejects more particles from the air stream. Depending on the turbulence required, rotation of the outer grid electrode (29) can also be performed in a preferred embodiment. The rotation of the grid electrodes is accomplished by the external motor (35) and an enclosed gear box (36).

Figure 6:
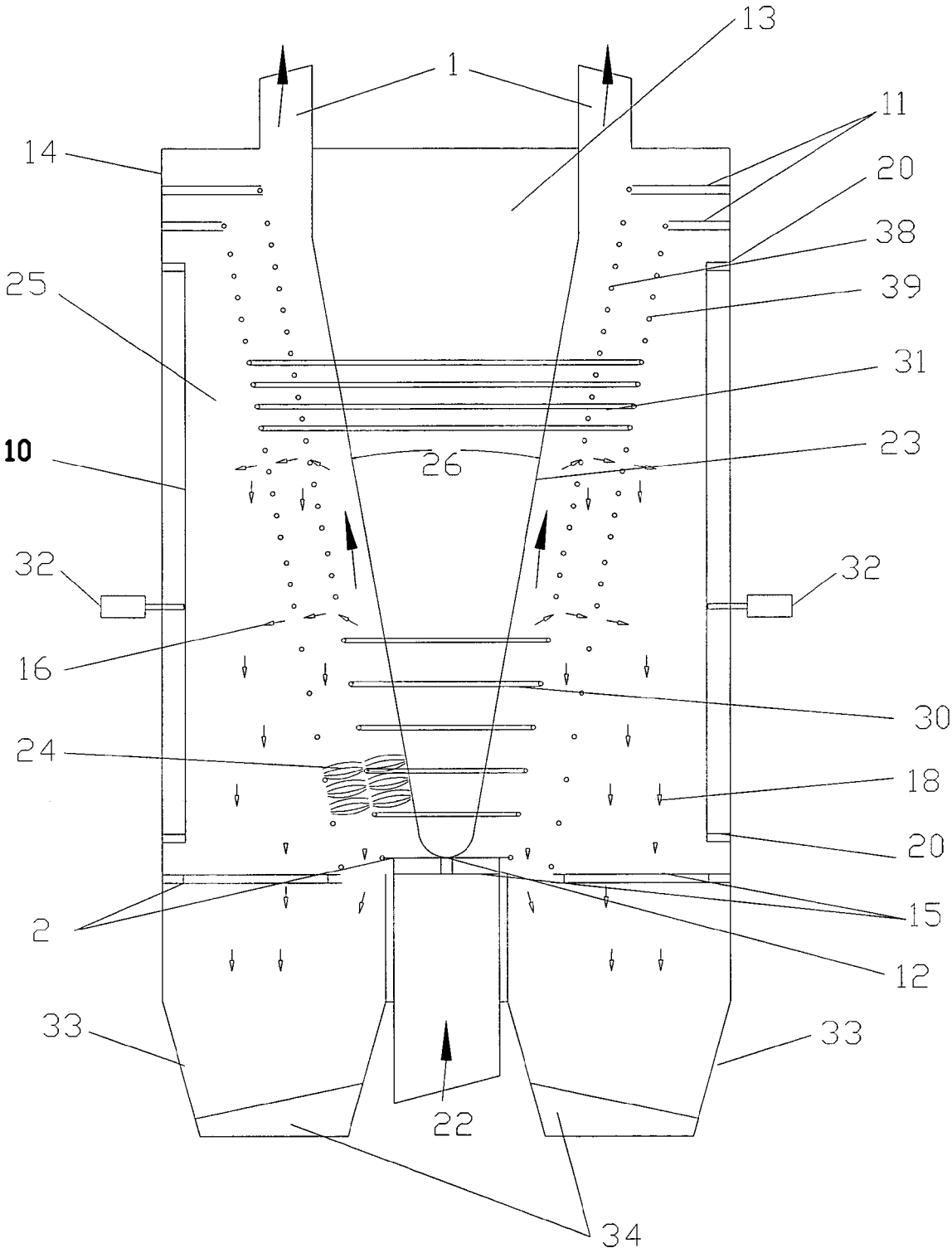
FIG. 6 shows a cross sectional view of a grid separator/collector of the present invention with a cone electrode, multiple grids with variable spacing, and a plate electrode precipitator.

FIG. 6 shows another cone separator design that varies the spacing of the circular grid wires (30) and (31) along the length of the cone electrode (23). This increases the electric field intensity as the concentration of particles decrease and is effective in processing an entrained stream that has a large particle size distribution removing the coarse particles and then the fine particles.

FIG. 6 also shows a cone electrode arrangement with two separate grid electrode and independent power input zones, (30) with a wider grid spacing, and (31) with a narrow grid spacing. Each electrode arrangement preferably has its own power supply that allows for the variation of both the electrical field intensity and the charge density along the processing length. In some cases, using more than one power supply supplements the need for variable electrode spacing.

Figure 7A:
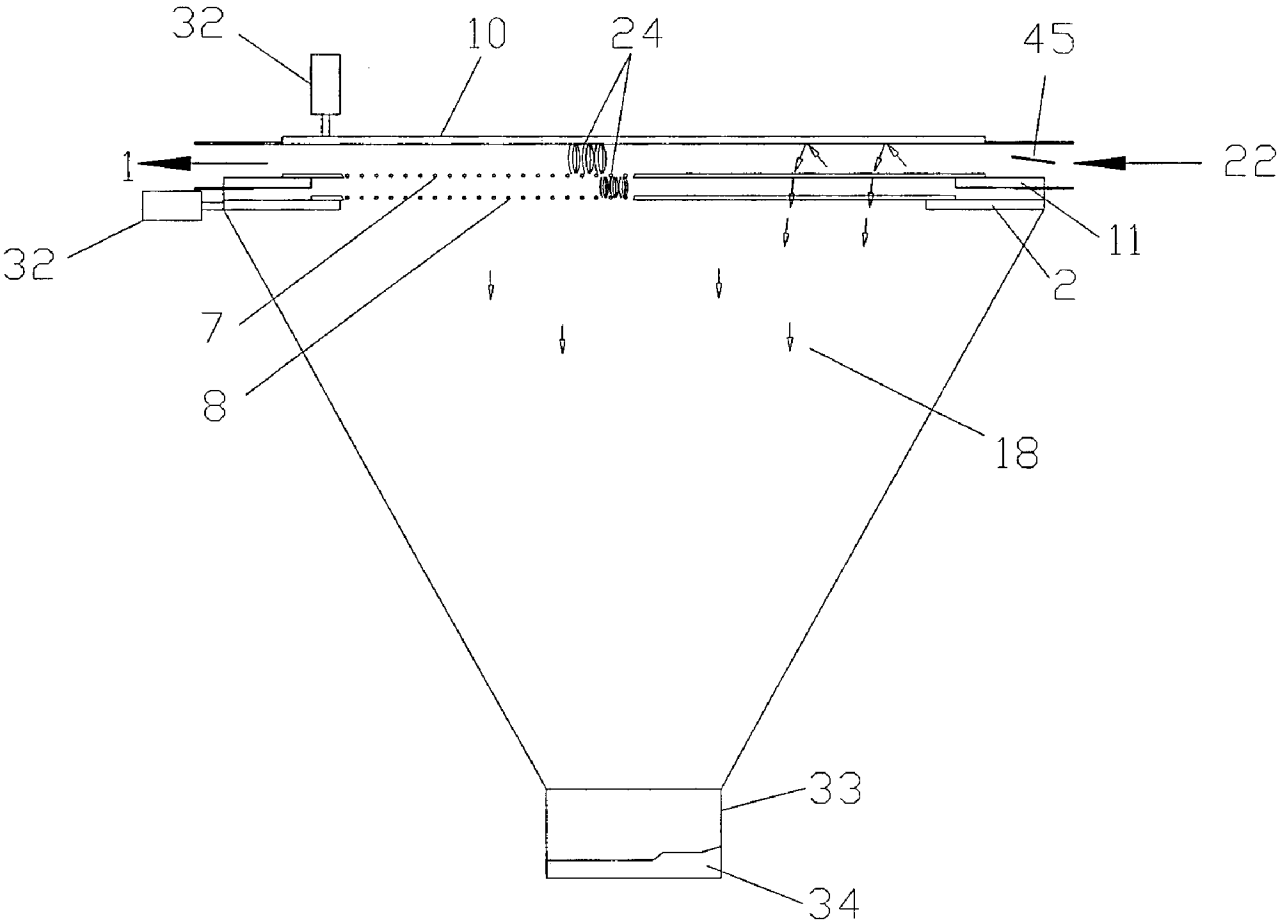
FIG. 7A shows a cross sectional view of a horizontal apparatus of the present invention that has a top plate electrode and multiple grids below.

FIG. 7A is a cross sectional view of a horizontal, rectangular operating unit primarily designed to process conductive materials. This precipitator preferably operates in an elevated position, where space and height are limited.

The collection and separation process is similar to the previous embodiments in that the entrained conductive particles are charged by induction as soon as they enter the electrode area. The apparatus is designed so that either the plate (10) or the wire grid electrode (7) can function as the charging electrode. By making the plate electrode (10) the charging electrode, the particles are first attracted to the plate and then the wire grid electrode (7). Particles are removed from the apparatus by passing through the first and second grids (7) and (8) and then falling by gravity (18) into the powder receptacle (34). With the polarity arrangement discussed above, the grid (7) is at ground potential and the plate (10) and the grid (8) electrodes operate in a charging mode. Depending on the distance between electrodes, the normal electrical operation is preferably between 15 and 30 KVDC. In a preferred embodiment, a deflector plate (45) that directs the entrained input air to flow toward the plate or wire grid electrode is also included in the design.

Figure 7B:
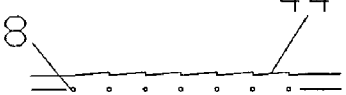
FIG. 7B shows a side view of a horizontal apparatus of the present invention that uses a contour electrode in place of the plate electrode.

FIG. 7B adds a component to enhance the performance of the unit shown in FIG. 7A. This embodiment replaces the plate electrode (10) with a contour electrode (44) with a matching wire pattern. The contour electrode (44) adds turbulence and periodically deflects the air stream towards the grounded electrode (7), resulting in a more efficient removal of the particulates.

Figure 8:
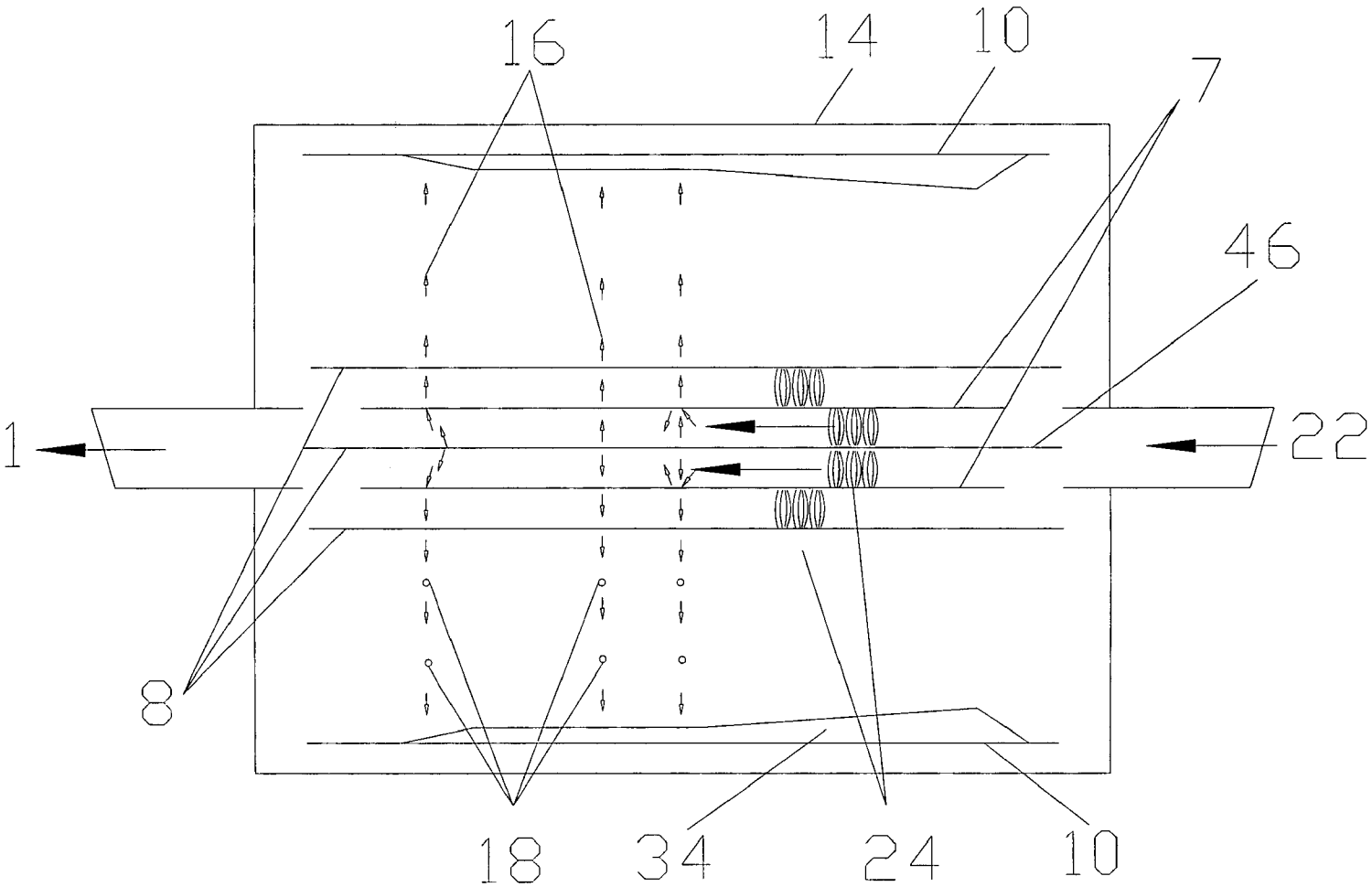
FIG. 8 shows a cross sectional view of a rectangular multiple grid separator/collector of the present invention that has a normally grounded center grid electrode located between two opposing charged electrodes.

FIG. 8 shows a top view of another preferred embodiment of the separator/collector. This embodiment is designed to operate with a high solid to gas ratio or when a high number of particle clusters are found in the material. Entrained air can enter either in a vertical mode or a horizontally mode as shown by (22) and flows between the grounded electrodes (7) and the charging plate or grid electrode (46), dividing the stream into basically two processing zones. The concentration or spacing between wire grids of each electrode is preferably varied to provide more or fewer lines of force that determine the number of trails a particle may have before moving laterally onto the next electrode grid. When the concentration of the solid is high, the center electrode (46) is the charging electrode and the electrodes (7) are at ground potential. These units preferably operate in a vertical position with either horizontal or perpendicular air input.

The polarities of the electrodes change when the apparatus processes clusters of powder that are lightly bonded and need more resident time to break down into smaller particles that respond to the electrical forces available.

FIG. 9 and FIG. 10 show another preferred design used to separate fine particles from an entrained air stream. As shown in the figures, the preferred shape for the electrodes is a "modified U shape"—meaning, that the shape is basically that of the letter "U", with a bottom portion and more-or-less perpendicular side portions. However, the "modified-U" preferred shape has sides which are not perpendicular, but angled nearly to a "V" shape, and the sides meet the bottom at a radius, rather than a right angle, as shown. Other variations are possible within the teachings of the invention.

The "modified U shaped" electrode assembly is a very efficient design and method for separating solids from an air stream. The major forces used to separate the particles from the air stream are: the force of gravity that exerts a vertical downward force, the electrical inductive field force generated between the plate and grid electrodes and the angular, tangential force exerted on the particles as they traverse the angular section and around the radius of solid and grid electrodes.

The combination of the electrical field and the physical radius of the modified-U shaped electrode contribute to efficient separation by inducing turbulence and drag components to the air stream and particles.

The entrained air enters at (47) and is immediately subjected to the electrical lateral forces established between the modified U shaped plate electrode (48) and the wire grid electrodes (52) and (53). The entrained air (50) is drawn down the surface of the modified U shaped plate electrode (48) by the exhaust system located after the exit (1). As the air (50) flows down the angular section (56), the particulates (49) are laterally expelled (51) from the airflow. When the entrained air reaches the start of the radius (54) or tangent point, shown in FIG. 10, the particles have a natural tendency to continue in a straight path due to the mass of the particulates. Particles traveling along the radius (55) are subject to additional stresses due to the increase in the drag forces on both the air and particulates. These physical forces combined with the electrical repelling forces produce a very efficient method for removing particulates from a moving air stream. Some of the other factors that affect the separation are the density and conductivity of the material, air velocity, air volume and solids to gas ratio.

In a preferred embodiment, the temperature of the U shaped plate electrode is controlled. The inside surface (57) can be heated or cooled by electrical or other means.

FIG. 9 also shows conducting wires (58) at electrical ground level. The conducting wires (58) neutralize electrical charges that remain on some of the particles after passing through the last grid electrode. This is especially useful for processing fine particulates. Similar devices can be used in all of the designs herein. Neutralizing the charge on the particles, especially the fine particles that have been separated from the air stream, is important in all of the embodiments of the present invention.

FIGS. 11A, 11B, 12A and 12B show two types of collecting electrodes, a louvered adjustable plate arrangement (59), and a multi-grid assembly (60) that includes two or more grids that are used to capture and prevent particle re-entrainment. In a preferred embodiment, the collecting electrodes in the multi-grid assembly (60) are perforated, to increase surface area and/or to reduce mass. In one embodiment, the multi-grid assembly (60) is made of expanded metal. During operation, the louvered plates are fixed in a selected position and impacted (132) at intervals related to particle loading.

The collection of particles that have been separated from the air stream is a two or three step process. The first step is to electrically transfer the moving particles laterally out of the main airflow. The second step is to allow these particles to fall by gravity or to be temporally captured by other electrodes. When a high concentration of polarized, fine-particles are being collected, immediate capture or deposit is desired. In an optional third step, particles with similar charges are electrically repelled back towards the air stream if the charges are not removed or if the particles are not temporally deposited on the plate electrode.

Figure 11A:
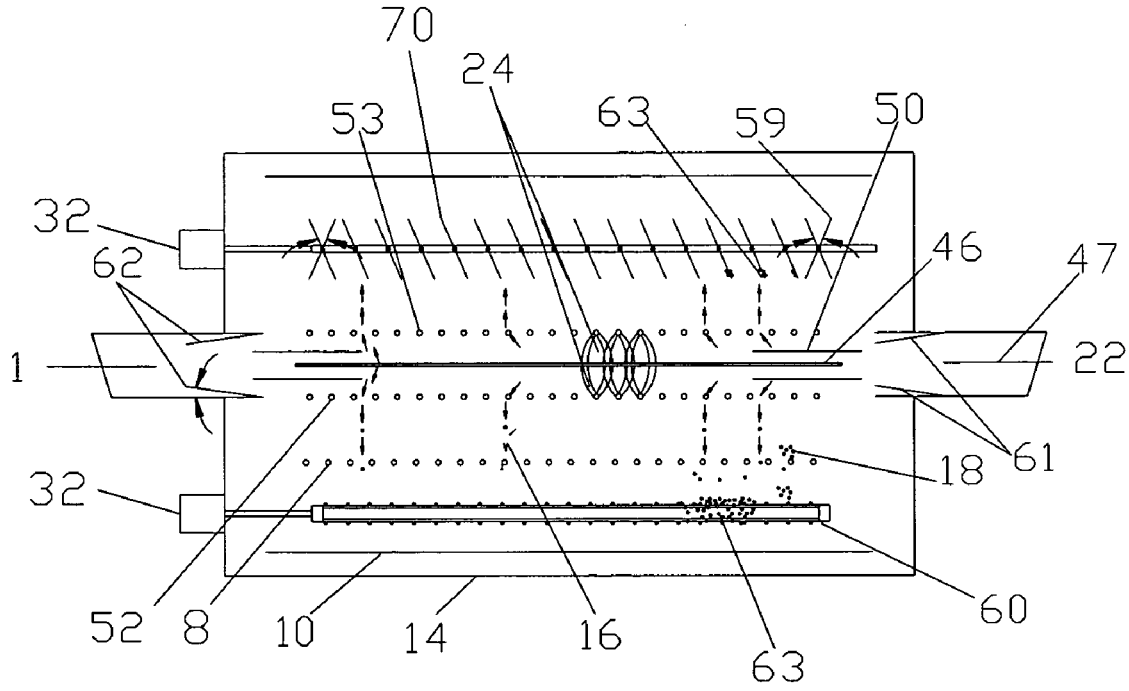
FIG. 11A shows a top view of a collector in another embodiment of the present invention.
Figure 11B:
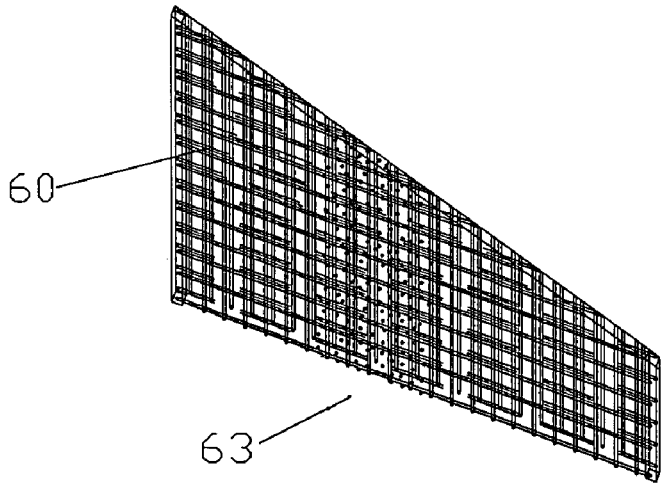
FIG. 11B shows a three dimensional, cut away view of the multi-grid electrode shown in FIG. 11A.

FIGS. 11A and 11B show a separator/collector that can use either a row of vertical, adjustable louvered plates that temporally collect particles on their surfaces or a multi-grid electrode assembly to temporally collect particles that have been removed electrically from the air stream.

In FIG. 11A, both the adjustable louvered plate electrode assembly and a multi-grid assembly are shown in the same apparatus. Fine particles that retain their charge after transferring laterally during the separation process may stay suspended without coalescing into larger particles because of the repulsion of like charges. This embodiment improves the process of collecting fine charged and uncharged particles. The louvered plate electrode assembly (59) includes a number of louvered plates (70) that are adjusted prior to operation and fixed during operation. When a single power supply is used and fine particles are being separated and collected, the finer particles require a stronger field strength between the main electrodes (52) and (53) to remove the particle from the air stream. Once the particle is out of the air stream, a lower field strength can be used. This is achieved by increasing the distance between the main (53) and louvered collecting electrodes (59).

The spacing between one of the main electrode assemblies (52) or (53) and one of the collecting electrode assemblies (59) and (60) is normally equal or greater than the spacing between the main electrode assemblies (52) and (53), especially when only one power source is used. When only four electrode assemblies (52), (53), (59), and (60), with alternating polarities, are used, the two main electrodes (52) and (53) are always at a higher potential then the collecting electrodes (59) or (60).

With alternating polarity, one of the collecting electrodes (59) or (60) may end up being charged; in processing some materials; this can result in particle re-entrainment. This problem is resolved by using a five-electrode assembly arrangement that allows for both collecting electrode assemblies (59) and (60) to operate at ground potential. FIG. 11A shows an additional grid placed between a main grid (52) and the multi-collector grid electrode (60), called the transfer grid electrode (8). In this electrode arrangement, the main grid (52) is preferably at ground potential, the transfer grid (8) is preferably charged and the multi-collecting grid electrode is preferably at ground potential. On the other side of the apparatus, the main grid electrode (53) preferably has a charge and the louvered plate electrode is preferably at ground potential.

The louvered plate electrode assembly (59) and the multi-grid assembly (60) can be moved close enough to the main grid electrodes (52) and (53) so that an attracting field can be established between the electrodes that enhance the transfer of the particles to the collecting electrodes (59) and (60). As discussed above, an alternative embodiment of the apparatus lacks the transfer grid electrode (8), and has only four electrode assemblies (52), (53), (59), and (60).

FIG. 11A shows the location of an adjustable aperture (61) at the input and an adjustable aperture (62) at the output. The width of the adjustable apertures (61) and (62) can be adjusted to vary the flow pattern either to favor the louvered plate electrode assembly (59) or the multi-grid assembly (60), or just to centralize the flow pattern. These apertures are adjusted when the main grid (52) and (53) spacing is changed.

FIG. 11B illustrates the design of one type of grid structure that has a combination of two or more opposing grids that have spacing between the grids. The spacing allows the collected particles to fall by gravity (63) during the tapping of the multi-grid electrode assembly (60). In the design shown, the bottom (65) of the grid electrode (60) is open, allowing for free fall of powder that has collected on the inside of the grid structure.

Depending on how the electrodes polarities are arranged, either grounded, HVDC or HVAC can be applied to the collecting electrodes. The powder collected on the louvered electrodes can be removed by a number of methods, which include, but are not limited to, impact, reverse, polarity and reverse HVAC, depending on the properties of the material collected. The powder dislodged from the louvered electrode assembly (59) falls by gravity into a receptacle without being re-entrained in the main stream of airflow.

Figure 12A:
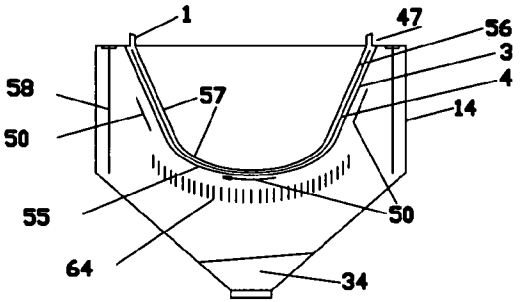
FIG. 12A shows a cross sectional view of a U-shaped electrode apparatus of the present invention, which uses multiple grid or plate collector electrodes to collect and remove electrical charges remaining on particles.
Figure 12B:
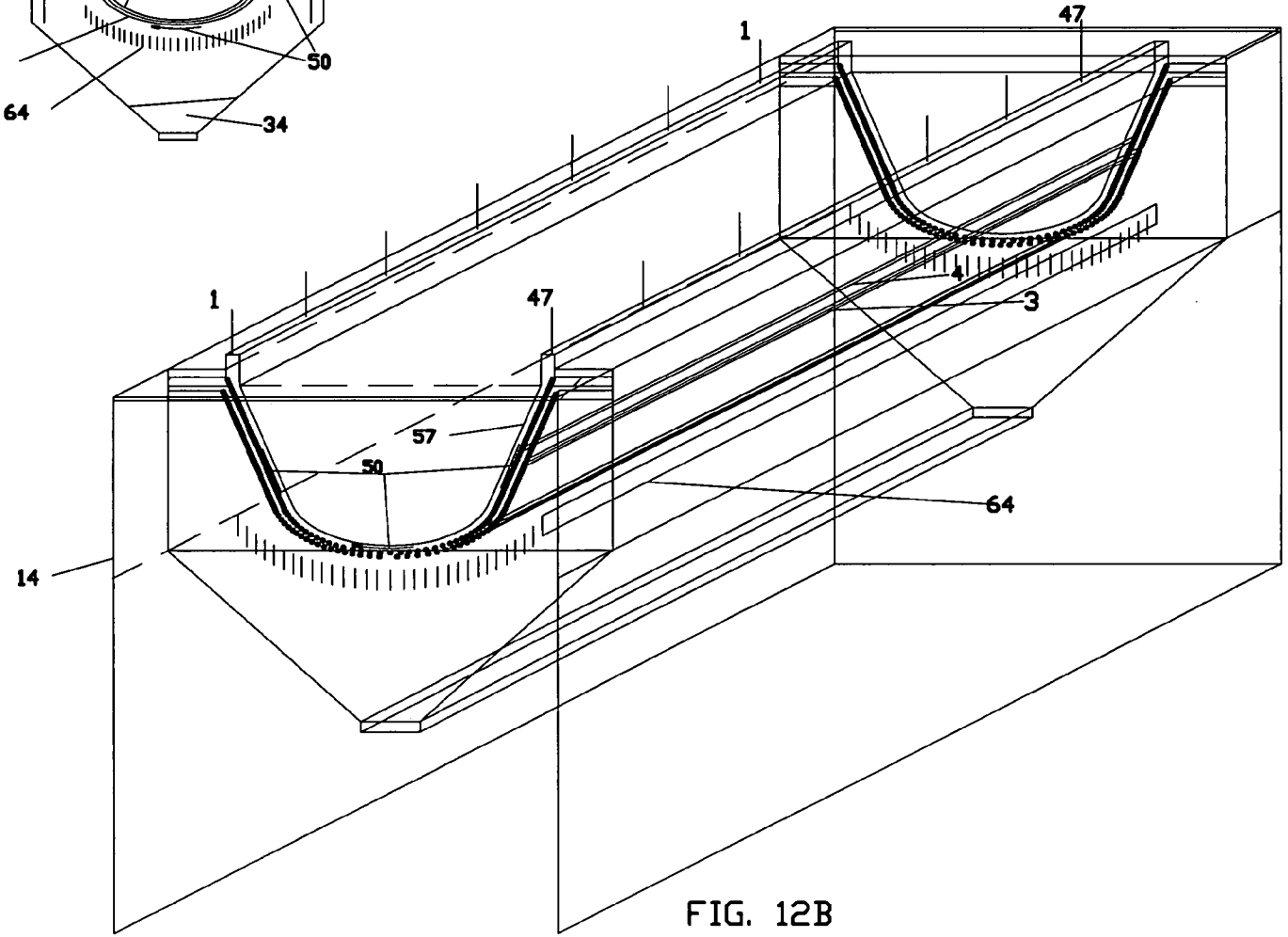
FIG. 12B shows a three-dimensional view of the U-shaped collector/separator of FIG. 12A.

FIGS. 12A and 12B show the relative position of separating grid electrodes (3) and (4) to the collecting plate electrode (64) used in the U-shaped apparatus. The distance of the collecting electrode plate assembly (64) can be placed close for greater attraction of particles to electrode (64) or at distance from the radius of electrode (4) so that there is essentially no attracting electrical field. When an electrical field is required, the grid electrode (3) is not used so that an electrical field can be established between the grounded plate electrodes (64) and the charged grid electrode (4). When the electrical field is not required, the grid electrode (3) is used at ground potential and the plate electrodes (64) are moved far enough away from each other so that they can either operate at ground potential or have a high voltage alternating current applied. The HVAC is preferably used to remove residual charges that remain on the materials while removing all traces of an electrical field will reduce chances of a power loss.

The present invention efficiently collects conductive and semi-conductive particles, similar to many bag filter systems. The apparatus of the present invention can be spray washed making it suitable to be used in the food and pharmaceutical industry.

Some advantages of the present invention include low operating and maintenance cost, competitive manufacturing cost, and no limitation on size of the particles that can be separated nor the size of the equipment. Multi-grid units similar to FIG. 1 are visible.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An apparatus for removing particles from a single air stream, comprising:

a) an input for the single air stream entering the apparatus;

b) an output located on an opposite side of the apparatus from the input, wherein the single air stream exits the apparatus at the output;

c) a plurality of grid electrodes located between the input and the output, wherein said single air stream enters said plurality of grid electrodes between two said grid electrodes; and d) a static air movement zone;

such that when opposite charges are applied to adjacent grid electrodes, an attractive field is created and the particles in the single air stream pass through at least one grid electrode into the static air movement zone where the particles are collected;

wherein the single air stream is selected from the group consisting of a single column of air flowing in a vertical direction and a single row of air flowing in a horizontal direction.

2. The apparatus of claim 1, further comprising:

d) an electric field generator, which generates at least one induced electric field between two grid electrodes, such that the induced electric field separates conductive and semi-conductive particles from the air stream.

3. The apparatus of claim 1, further comprising a plurality of corona wires, which generate a plurality of polarized ions;

wherein the grid electrodes are selected from the group consisting of charged grids or grounded grids;

wherein the grid electrodes attract the particles such that the grid electrodes and the corona wires separate non-conductive particles from the air stream.

4. The apparatus of claim 1, wherein the grid electrodes comprise a vertical grid.

5. The apparatus of claim 1, wherein the grid electrodes comprise a horizontal grid.

6. The apparatus of claim 5, further comprising a solid plate electrode, located above and parallel to the grid electrodes.

7. The apparatus of claim 1, wherein the grid electrodes comprise modified-U-shaped horizontal grid electrodes.

8. The apparatus of claim 1, wherein the input comprises an adjustable input orifice.

9. The apparatus of claim 1, wherein the output comprises an adjustable output orifice.

10. The apparatus of claim 1, further comprising d) at least one corona discharge electrode located parallel to the grid electrodes.

11. The apparatus of claim 1, further comprising d) at least one collecting electrode located between the input and the output.

12. An apparatus for removing a plurality of entrained, charged non-conductive particles from an air stream comprising:

a) an input for the air stream entering the apparatus;

b) an output located on an opposite side of the apparatus from the input, wherein the air stream exits the apparatus at the output;

c) a plurality of grid electrodes located between the input and the output;

d) at least one corona discharge electrode located parallel to the grid electrodes; and e) at least one collecting plate electrode located between the input and the output and outside the grid electrodes;

such that, when the corona discharge electrodes, the parallel grid electrodes, and the collecting plate electrode are electrically active, the particles pass through the grid electrodes while the gas continues to flow out of the system.

13. The apparatus of claim 12, wherein the air stream is selected from the group consisting of a single column of air flowing in a vertical direction and a single row of air flowing in a horizontal direction.

14. The apparatus of claim 12, wherein the input comprises an adjustable input orifice.

15. The apparatus of claim 12, wherein the output comprises an adjustable output orifice.

16. An apparatus for temporally collecting particles that have been separated from an air stream comprising:

a) at least two main grid separating electrode assemblies substantially parallel to each other, each comprising a plurality of main grid separating electrodes;

b) a plurality of vertical collecting grid type electrodes, wherein each of the collecting grid type electrodes has either a ground potential or an opposite polarity as the main grid separating electrode immediately adjacent to it such that an attracting field transfers a plurality of the separated particles to a surface of the collecting grid type electrodes; and c) a plurality of vertical louvered collecting plate electrodes, wherein each of the louvered collecting plate electrodes has either a ground potential or an opposite polarity as the main grid separating electrode immediately adjacent to it such that an attracting field transfers a plurality of separated particles to a surface of the louvered collecting plate electrodes.

17. The apparatus of claim 16, wherein the air stream is selected from the group consisting of a single column of air flowing in a vertical direction and a single row of air flowing in a horizontal direction.

18. The apparatus of claim 16, wherein the grid electrodes comprise modified-U-shaped grid electrodes.

19. The apparatus of claim 16, wherein the collecting grid type electrodes are perforated.

20. The apparatus of claim 16, wherein there are three main grid separating electrode assemblies.

21. The apparatus of claim 16, wherein the louvered collecting plate electrodes and the collecting grid type electrodes are at ground potential.

22. An apparatus for separating and removing a plurality of entrained, non-conductive particles from a plurality of conductive particles in an air stream comprising:

a) an adjustable input orifice for the air stream entering the apparatus;

b) an adjustable output orifice located on an opposite side of the apparatus from the input orifice, wherein the air stream exits the apparatus at the output orifice;

c) a plurality of grid electrodes located between the input orifice and the output orifice;

d) at least one corona discharge electrode located externally and parallel to the grid electrodes; and e) at least one collecting electrode located behind and parallel to the grid electrodes and between the input orifice and the output orifice;

such that the conductive particles pass laterally through the grid electrodes and onto the collecting electrode, while gas and the non-conductive particles continue to flow out of the apparatus.

23. The apparatus of claim 22, wherein the air stream is selected from the group consisting of a single column of air flowing in a vertical direction and a single row of air flowing in a horizontal direction.

24. The apparatus of claim 22, wherein the collecting electrode is selected from the group consisting of a plate electrode and a grid electrode.

25. The apparatus of claim 24, wherein the grid electrodes comprise modified-U-shaped grid electrodes.

26. The apparatus of claim 1, further comprising a blower located at an output end of the apparatus that draws air from the air stream into the apparatus.

27. An apparatus for removing particles from a single air stream, comprising:

a) an input for the single air stream entering the apparatus;

b) an output located on an opposite side of the apparatus from the input, wherein the single air stream exits the apparatus at the output;

c) a plurality of grid electrodes located between the input and the output, wherein said single air stream enters said plurality of grid electrodes between three said grid electrodes; and d) a static air movement zone;

such that when opposite charges are applied to adjacent grid electrodes, an attractive field is created and the particles in the single air stream pass through at least one grid electrode into the static air movement zone where the particles are collected;

wherein the single air stream is selected from the group consisting of a single column of air flowing in a vertical direction and a single row of air flowing in a horizontal direction.

* * * * *